US009677312B2

(12) United States Patent
Marsh et al.

(10) Patent No.: US 9,677,312 B2
(45) Date of Patent: Jun. 13, 2017

(54) WINDOW REGULATOR GUIDE RAIL

(71) Applicant: AXIOM GROUP INC., Aurora (CA)

(72) Inventors: Chris Marsh, Aurora (CA); Kristian Cauyan, Aurora (CA); Timothy Pang, Aurora (CA)

( * ) Notice: Subject to any disclaimer, the term of this patent is extended or adjusted under 35 U.S.C. 154(b) by 0 days.

(21) Appl. No.: 14/590,424

(22) Filed: Jan. 6, 2015

(65) Prior Publication Data

US 2015/0191953 A1 Jul. 9, 2015

Related U.S. Application Data

(60) Provisional application No. 61/923,835, filed on Jan. 6, 2014.

(51) Int. Cl.
*E05F 11/48* (2006.01)
*E05D 15/16* (2006.01)
*E05F 15/689* (2015.01)

(52) U.S. Cl.
CPC ..... *E05F 11/485* (2013.01); *E05D 15/165* (2013.01); *E05F 11/48* (2013.01); *E05F 11/481* (2013.01); *E05F 11/483* (2013.01); *E05F 15/689* (2015.01)

(58) Field of Classification Search
CPC ..... E05F 11/48; E05F 11/481; E05F 11/483; E05F 11/485
USPC ..... 49/352, 348
See application file for complete search history.

(56) References Cited

U.S. PATENT DOCUMENTS 4,644,695 A * 2/1987 Shiraishi ..... E05F 11/488 49/352
4,657,523 A * 4/1987 Chevance ..... E05F 11/485 474/101
5,370,587 A * 12/1994 Johnson ..... F16D 1/0858 474/166
6,125,712 A * 10/2000 Kaburagi ..... F16D 1/108 403/14
6,584,731 B2 * 7/2003 Arquevaux ..... E05F 11/485 49/352
7,472,515 B2 * 1/2009 Mazouzi ..... E05F 11/485 49/352
7,877,932 B2 * 2/2011 Kriese ..... B60J 1/17 49/348
7,958,676 B2 * 6/2011 Kruger ..... B60J 1/17 49/352
8,127,496 B2 * 3/2012 Maruyama ..... E05F 11/483 49/348
8,555,549 B2 * 10/2013 Cardine ..... E05F 11/485 49/349
2003/0097795 A1 * 5/2003 Dufour ..... E05F 11/483 49/352

(Continued)

FOREIGN PATENT DOCUMENTS

DE 10156056 A1 * 5/2003 ..... E05F 11/483
FR GB 2388158 A * 11/2003 ..... E05F 11/483

OTHER PUBLICATIONS

Translation of DE 10156056.*

*Primary Examiner* — Katherine Mitchell
*Assistant Examiner* — Marcus Menezes
(74) *Attorney, Agent, or Firm* — Perry + Currier Inc.

(57) ABSTRACT

A window regulator guide rail is provided, including an elongated body having a snap anchor; and a ring rotatably coupled to the rail via engagement with the snap anchor, the ring for guiding a cable.

8 Claims, 7 Drawing Sheets

(56) References Cited

U.S. PATENT DOCUMENTS

| | | | | |
|---|---|---|---|---|
| 2004/0049986 | A1* | 3/2004 | Barr | E05F 11/488<br>49/352 |
| 2004/0134130 | A1* | 7/2004 | Dobson | E05F 11/486<br>49/352 |
| 2004/0211122 | A1* | 10/2004 | Freymuth | B60J 5/0416<br>49/502 |
| 2004/0255516 | A1* | 12/2004 | Dufour | E05F 11/485<br>49/352 |
| 2005/0016070 | A1* | 1/2005 | Cardine | E05F 11/485<br>49/352 |
| 2005/0194580 | A1* | 9/2005 | Mazouzi | E05F 11/485<br>254/231 |
| 2008/0098655 | A1* | 5/2008 | Valentage | E05F 11/382<br>49/352 |
| 2008/0222962 | A1* | 9/2008 | Staser | B60J 5/0416<br>49/502 |
| 2010/0119295 | A1* | 5/2010 | Renke | E05F 11/483<br>403/14 |
| 2011/0185639 | A1* | 8/2011 | Staser | B60J 5/0416<br>49/506 |
| 2013/0098183 | A1* | 4/2013 | Fever | E05F 11/481<br>74/89 |

* cited by examiner

WINDOW REGULATOR GUIDE RAIL

CROSS-REFERENCE TO RELATED APPLICATION

The present application claims priority from U.S. provisional patent application No. 61/923,835, filed Jan. 6, 2014, the contents of which are hereby incorporated by reference.

FIELD

The specification relates generally to window regulators for vehicle doors, and specifically to a guide rail for a window regulator.

BACKGROUND

Window regulator existing technology typically has a metal rail (or two) that provides a guide and surface for the lifter plate to slide up and down along—this being the part of the window regulator that connects to the glass. Generally, the rail is made of metal to overcome some of the high loads applied by the motor and the varying conditions in service. Loading under hot and humid conditions tends to be the worst strain on the window regulator as a system.

Today's trend is to consider light weight solutions. To replace a metal rail with a lighter material such as plastic, one must consider the worst case loading conditions. Typically, the worst case loading conditions are found in high heat (+80 C) and high humidity (100% RH). These types of test environments are used to simulate areas of the world that have long term high heat and humidity such as Florida in the southern US.

These loading conditions complicate the design of non-metal rails due to the difficulty in designing with those materials to accommodate the loads that will be imposed. For instance, materials such as plastic may not be at their ideal strength conditions under hot and humid conditions, and the structure required to support the necessary loads in such environments can lead to an excessive amount of supporting plastic structure to overcome these loading conditions. Potentially, the amount of supporting plastic structure can raise costs and make it difficult to package the design—big and bulky means hard to package in a typical car door environment.

BRIEF DESCRIPTIONS OF THE DRAWINGS

Embodiments are described with reference to the following figures, in which.

DETAILED DESCRIPTION OF THE EMBODIMENTS

Figure 1:
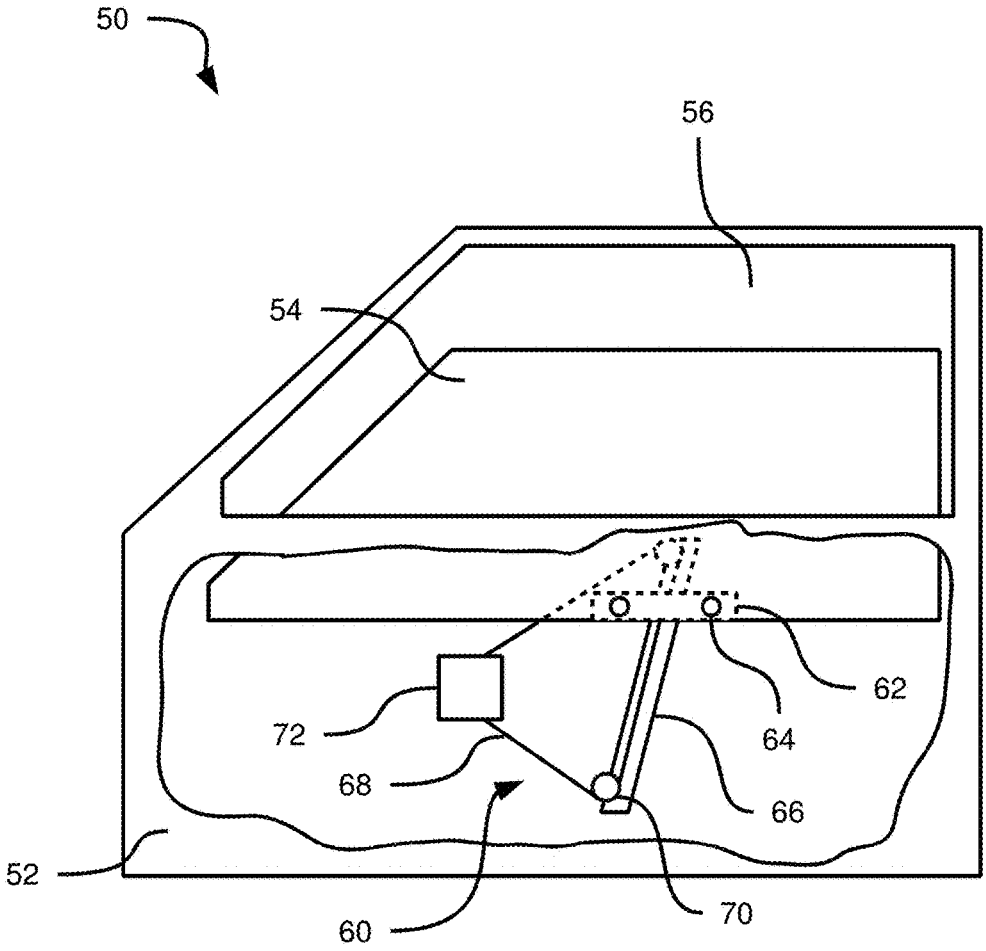
FIG. 1 depicts a window regulator system, including a guide rail, installed in a vehicle door.

FIG. 1 depicts shows a door 50 of a vehicle (e.g. an automobile) with a cutaway illustrated in a body or panel 52 of the door 50 to illustrate certain internal components of the door 50. Supported by the body 52 is a window 54. The window 54 is configured to slide between a closed position and an open position. In the closed position (also referred to as a raised position), the window 54 obstructs an opening 56 defined by the body 52 of the door 50. In the open position (also referred to as a lowered position), the opening 56 is substantially or entirely unobstructed by the window 54; instead, the window 54 is supported substantially or entirely within the body 52, leaving the opening 56 open and thus allowing air to circulate through the opening 56 between the interior and the exterior of the vehicle.

The window 54 is moved between the open and closed positions by a window regulator system 60 mounted within the body 52 of the door 50. The window regulator system includes a bracket or lifter plate 62 secured to the window 54 by rivets 64 or other fasteners. The bracket 62, in turn, is slideably connected to a guide rail 66 fixed to the interior of the body 52. The bracket 62 is connected to each end of a cable 68. The cable 68, from each end thereof, travels from the bracket 62 over pulleys 70 located at each end of the guide rail 66 and to a bidirectional motor 72. When activated by a switch (not shown) mounted on the door 50, the motor 72 can apply tension to one of the two ends of the cable 68, thus either pulling the bracket 62 upwards along the guide rail (that is, towards the opening 56) to close the window 54, or pulling the bracket 62 downwards along the guide rail (that is, into the body 52 and away from the opening 56) to open the window 54.

In other embodiments, additional guide rails may be included. For example, the bracket 62 may extend between a pair of guide rails. In still other embodiments, the bracket 62 itself may be replaced with two brackets, each mounted on a respective guide rail.

The guide rail 66 includes certain features distinguishing the guide rail 66 from guide rails employed in conventional window regulator systems. Those features will be discussed in greater detail below.

Figure 2:
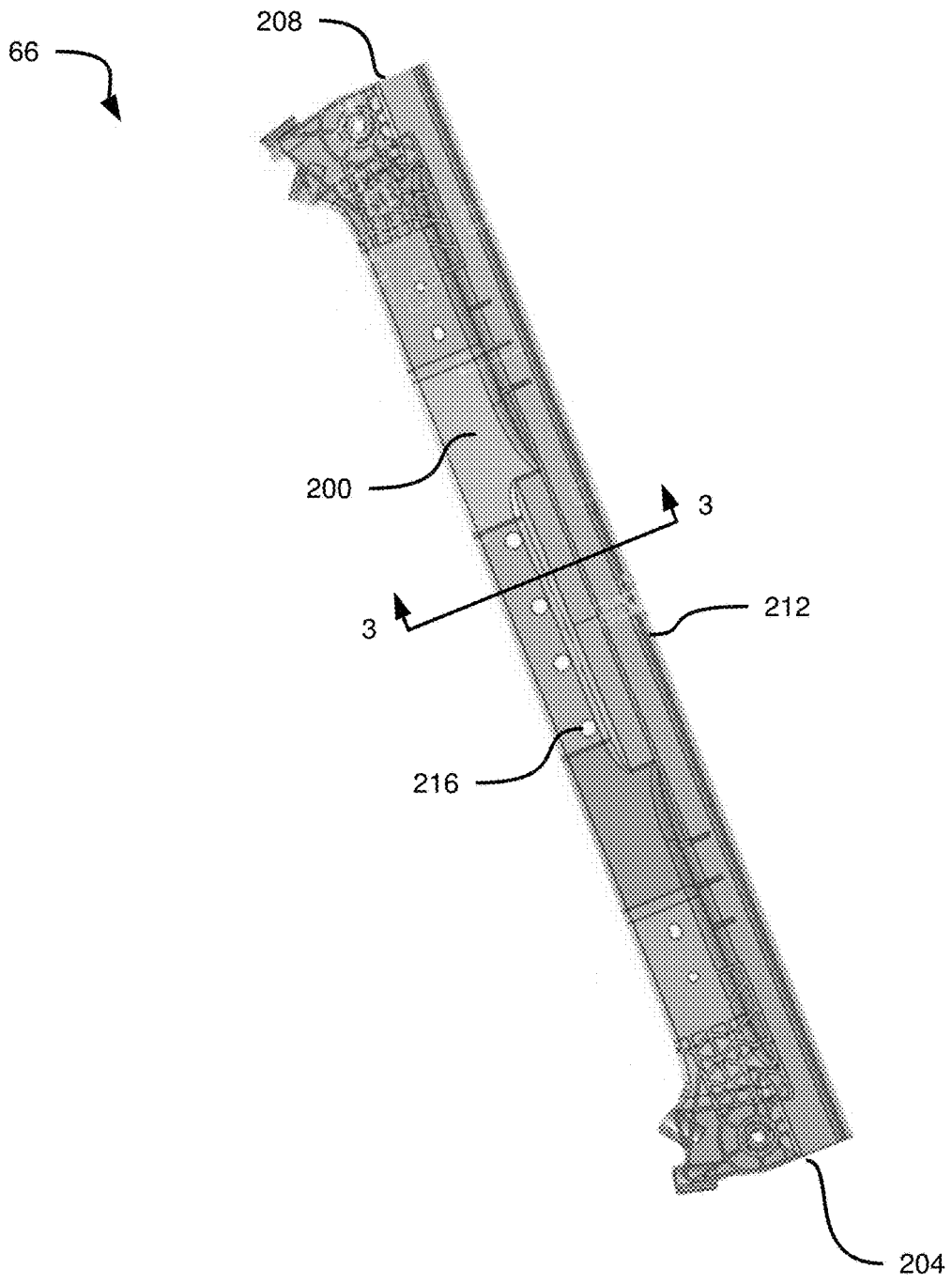
FIG. 2 depicts the guide rail of FIG. 1, according to a non-limiting embodiment.
Figure 3:
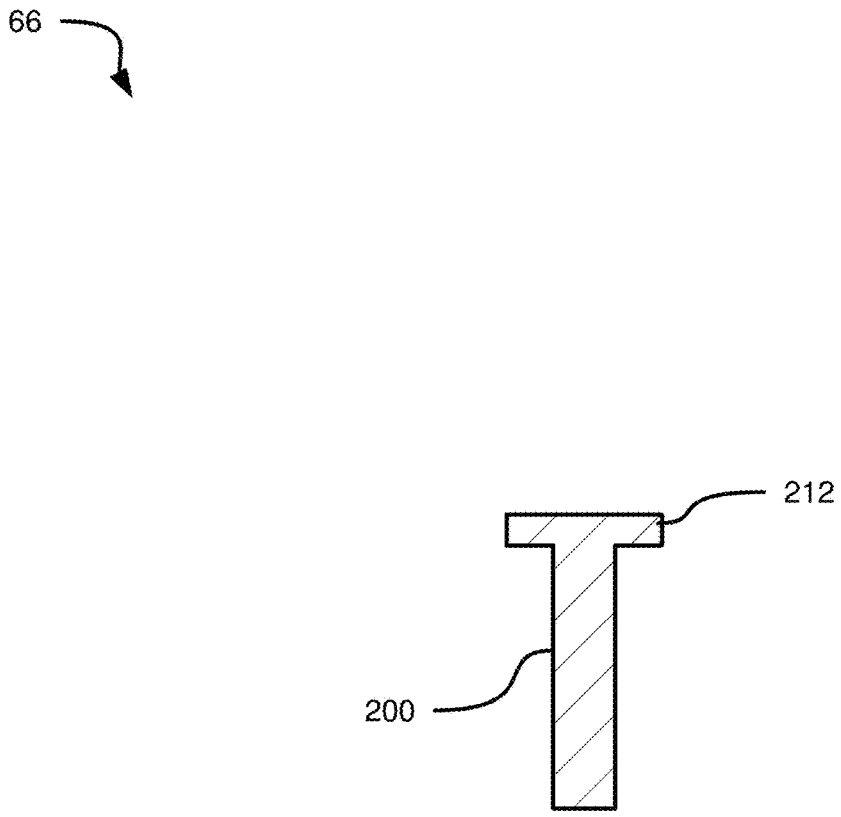
FIG. 3 depicts a cross-section of the guide rail of FIG. 2 along line 3-3 shown in FIG. 2, according to a non-limiting embodiment.

Referring now to FIG. 2, the guide rail 66 is illustrated in isolation, viewed from the rear side (the side opposite that shown in FIG. 1). The guide rail 66 includes an elongated body 200 extending between opposing ends 204 and 208. The body 200 defines a track 212 along an edge thereof, onto which the bracket 62 is slideably connected. The track 212, as illustrated in FIG. 3, extends outwardly from the body 200, and can be received within a structure of the bracket 62.

Returning to FIG. 2, the guide rail 66 also includes various openings 216 for fastening the guide rail 66 to the interior of the door body 52.

Figure 4:
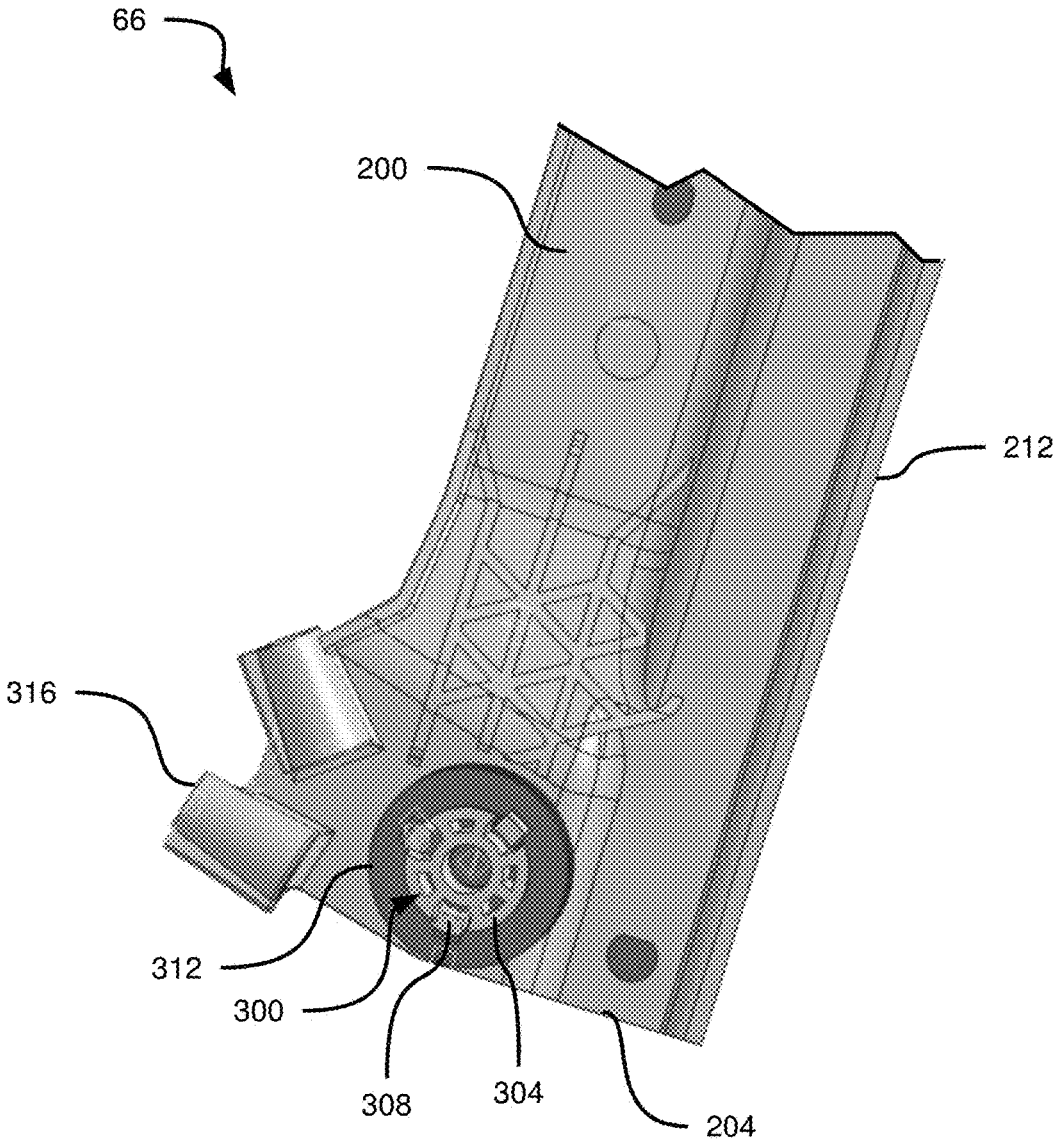
FIG. 4 depicts an end portion of the guide rail of FIG. 1, according to a non-limiting embodiment.

Referring now to FIG. 4, a portion of the guide rail 66 including the end 204 is illustrated. As will be apparent to those skilled in the art, the portion of the guide rail 66 illustrated in FIG. 4 is shown from the opposite side as the depiction of the guide rail in FIG. 2. As seen in FIG. 4, the guide rail 66 includes, adjacent to the end 204, a snap anchor 300 extending outwardly from the body 200. In the present embodiment, the anchor 300 is integrally formed with the body 200, for example in an injection molding process.

The anchor 300 includes a cylindrical barrel 304 with a first radius, and at least one locking member extending to a second radius (measured from a central axis of the barrel 304) greater than the first radius. In the present embodiment, the locking member includes three flexible snap members 308 formed integrally with the barrel 304. Each snap member 308 is biased towards the position shown in FIG. 4, in which the end of the snap member 308 is located at a greater radial distance from the central axis of the barrel 304 than the outer surface of the barrel 304 itself. In other embodiments, the barrel 304 and snap members 308 can be replaced with a separate component (not shown) that extends through the pulley ring 312 and snaps onto the body 200. Such a component has an outer flange with a greater outer diameter than the diameter of the opening in the ring 312. In a further embodiment, the barrel 304 can be retained, but the snap members 308 can be omitted. Instead, the pulley ring 312 can fit over the barrel 304, and an additional component can be inserted through the barrel 304 (and, by extension, through the pulley ring 312), with an expanding snap member that expands to a diameter greater than the inner diameter of the barrel 304 upon reaching the other side of the body 200 (that is, having passed through the barrel 304).

The guide rail 66 includes a pulley ring 312 having a central opening with a radius that is larger than the radius of the barrel 304 but smaller than the radial distance between the central axis of the barrel 304 and the ends of the snap members 308. The ring 312 can be pressed onto the barrel 304, thus deforming the snap members 308 to fit through the central opening of the ring 312. When the ring 312 has descended onto the barrel 304, the protruding ends of the snap members pass through the central opening of the ring 312 and can return to their resting position, as shown in FIG. 4. Thus, the ring 312 is retained on the barrel 304 by the snap members 308. The ring 312, when mounted on the barrel 304, is rotatable about the barrel 304.

The guide rail 66 also includes at least one tube socket 316 adjacent to the ring 312 (and thus adjacent to the end 204). In the present embodiment, a pair of tube sockets 316 are included. In other embodiments, one or no tube sockets 316 can be included. Another tube socket 316, or pair of tube sockets 316, are included adjacent to the other end 208 of the guide rail 66 (another anchor 300 and ring 312 are also provided adjacent to the end 208 of the guide rail 66). The tube socket 316 defines a channel therethrough for receiving the cable 68. The cable 68 travels from the motor 72, through the tube socket 316, and around a portion of the ring 312 to travel along the length of the body 200 towards the bracket 62. At the other end 208 of the guide rail 66, the other end of the cable 68 takes a similar path. window regulator system 60 can include one or more cable conduits coupled between the motor 72 and the tube sockets 316, through which the cable 68 travels.

Figure 5:
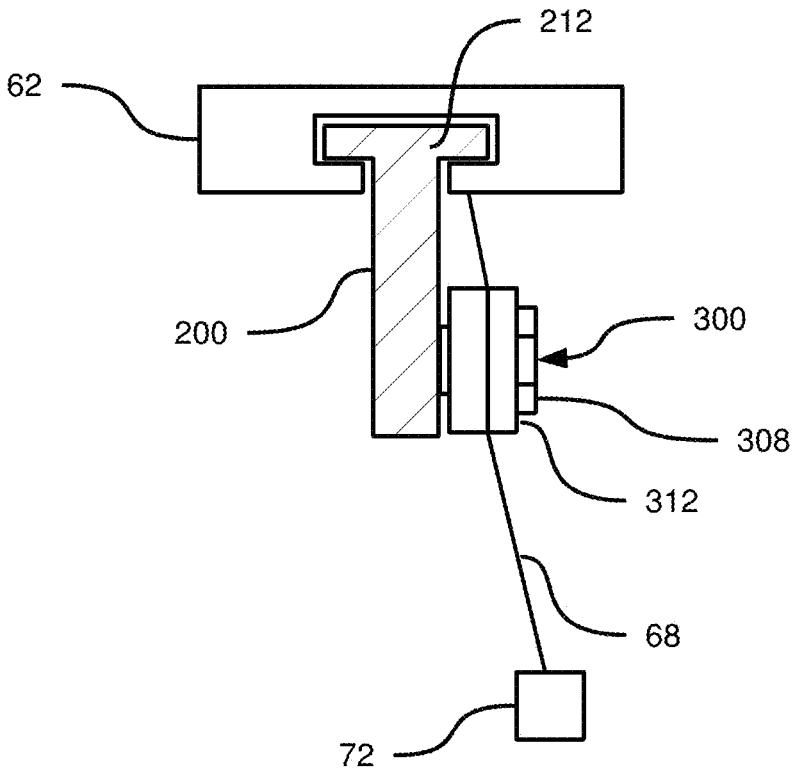
FIG. 5 depicts a partial cross-section of the guide rail of FIG. 2 along line 5-5 shown in FIG. 1, according to a non-limiting embodiment.

In the present embodiment, the cable 68 may be attached to the bracket 62 in such a way as to reduce the stress placed on the snaps 308. Referring now to FIG. 5, a cross-section of the guide rail 66 is shown, including a depiction of the bracket 62, the anchor 300 and the ring 312. The cable 68 is shown arriving on the ring 312 from the motor 72, and attaching to the bracket 62. Of note, the point of attachment of the cable 68 on the bracket 62 is closer to the body 200 than is the path of the cable 68 along the ring 312. Thus, the cable 68 exerts some pressure on the ring 312 towards the body 200 (and away from the snaps 308), reducing the strength of the snaps 308 required to prevent the ring 312 from falling from the anchor 300.

The guide rail 66 may be fabricated from a variety of materials, but is preferably made of a flowable plastic material by injection molding. In the present embodiment, the tube sockets 316, the barrels 304 and the body 200 are formed of a single piece of material, for example in a single injection molding process.

Certain advantages of the guide rail 66 described herein will be discussed below.

Under load, the guide rail 66 can be subjected to bending moments perpendicular to the face of the guide rail 66 that occurs from the loading in the cable 68 and is passed through the pulley ring 312, in particular at the top of the guide rail 66. In conventional guide rails, a pulley may be fastened to the guide rail by a rivet. Such loading can, in conventional guide rails, cause failure of the guide rail by causing the rivet to pull through the guide rail. The use of anchor 300 and ring 312 as discussed above can reduce the incidence of this mode of failure by reducing or eliminating the stress concentrations introduced by rivets.

The use of anchor 300 with snaps 308 to hold the pulley ring 312 onto the guide rail 66 can also allow for reduced manufacturing costs, as parts such as rivets or other fasteners may be eliminated, along with corresponding equipment such as rivet forming stations.

Additionally, the replacement of fasteners such as rivets with the integrated anchor 300 can increase the ease of ensuring that the guide rail 66 is correctly assembled. Process control studies (such as rivet retention studies), for example, may be omitted. Other advantages include weight reduction, and increased ease of recycling due to less dissimilar materials.

Figure 6:
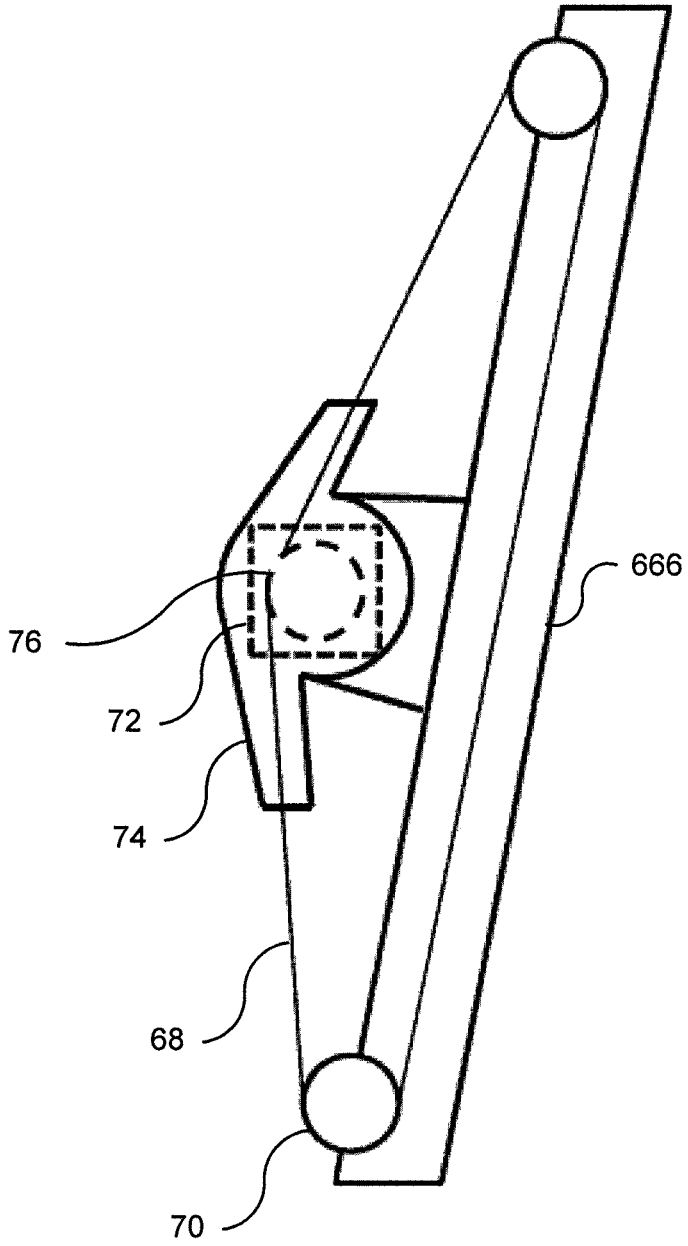
FIG. 6 depicts a window regulator system, including another embodiment of the guide rail, according to a non-limiting embodiment.

Other part integrations are also contemplated. For example, a housing 74 for a cable drum 76 (for example as shown in FIG. 6) can also be integrated with the guide rail 666. The housing 74 and cable drum 76 spool the cable onto and off of as the motor (or manual crank) moves the cable to achieve the glass motion up or down.

Figure 7:
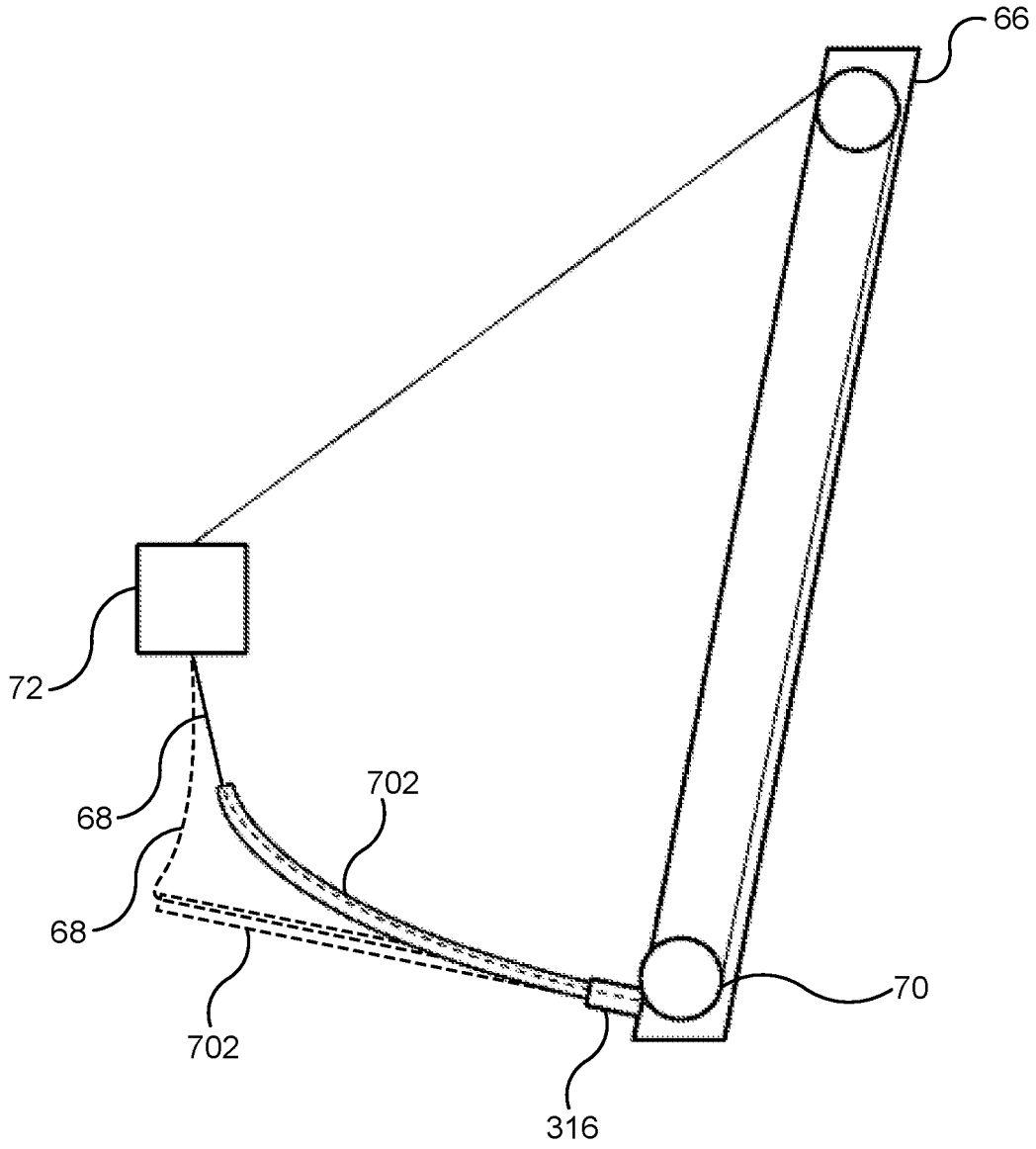
FIG. 7 depicts a window regulator system, including yet another embodiment of the guide rail, according to a non-limiting embodiment.

Another contemplated feature is the elimination of the metal conduit. A conduit provides a channel through which the cable travels. Conventional conduits are metal, with a plastic coating on their interior to reduce friction with the cable. It is contemplated that, as shown in FIG. 7, in addition to the above features, a cable conduit 702 can be provided that is manufactured from plastic rather than metal. A plastic conduit may provide one or more of lower weight and lower cost, and may also have a safer failure mode: when a metal conduit fails, the resulting sharp edges can damage the cable, resulting in catastrophic failure of the window regulator system. A failed plastic conduit, on the other hand, is less likely to produce sharp edges that damage the cable.

In addition, it is contemplated that the plastic conduit 702 can be biased towards a straight position, such that as the conduit 702 straightens as the window moves, the conduit 702 itself acts as a spring to take up slack cable. Conventional conduit designs use springs mounted within one or both of the tube sockets at the ends of the conduit to effect cable take-up. Such springs may be eliminated using plastic conduit 702.

Persons skilled in the art will appreciate that there are yet more alternative implementations and modifications possible for implementing the embodiments, and that the above implementations and examples are only illustrations of one or more embodiments. The scope, therefore, is only to be limited by the claims appended hereto.

We claim:

1. A window regulator system, comprising:

an elongated body defining a track along an edge of the body;

a bracket slideably coupled to the track;

an anchor for connection to the elongated body, the anchor comprising a cylindrical barrel and one or more members extending radially away from the cylindrical barrel, the anchor having a compact configuration whereby the one or more members are radially at a first distance from a center of the cylindrical barrel and an extended configuration whereby the one or more members are radially at a second distance from the center of the cylindrical barrel, the second distance greater than the first distance, the one or more members resiliently biased towards the extended configuration; and a pulley ring rotatably coupled to the body via engagement with the anchor, the pulley ring having a central opening configured for receiving the cylindrical barrel when the anchor is in the compact configuration, wherein after the cylindrical barrel is received in the central opening, the anchor resiliently returns to the extended configuration to secure the pulley ring to the body;

a tube socket integrally formed with the elongated body;

a cable conduit coupled to the tube socket;

the pulley ring, the tube socket, and the cable conduit are configured to receive a cable extendable from the bracket over the pulley ring, through the tube socket, through the cable conduit, and towards a motor for tensioning the cable to move the bracket along the track;

wherein:

when the cable is untensioned, the cable conduit comprising of substantially resilient material which biases the cable conduit in a first direction; and when the cable is tensioned, the cable conduit is configured to be resiliently deformed by the cable towards a second direction deviating from the first direction; and wherein the cable conduit is cantilevered at one end thereof and the tube socket and the cable conduit are springless.

2. The window regulator system of claim 1, wherein the elongated body and the pulley ring are plastic.

3. The window regulator system of claim 1, wherein the anchor and the elongated body are integrally formed.

4. The window regulator system of claim 1, further comprising:

a housing for a cable drum integrally formed with the elongated body.

5. The window regulator system of claim 1, wherein the cable conduit is plastic.

6. The window regulator system of claim 1, further comprising the cable.

7. The window regulator system of claim 1, further comprising the motor.

8. The window regulator system of claim 7, wherein the motor comprises a bidirectional motor.

* * * * *